US009718172B2

(12) United States Patent
Sakamaki et al.

(10) Patent No.: US 9,718,172 B2
(45) Date of Patent: Aug. 1, 2017

(54) ELECTRIC TOOL

(71) Applicant: MAX CO., LTD., Tokyo (JP)

(72) Inventors: Kazuya Sakamaki, Tokyo (JP); Kouji Katou, Tokyo (JP)

(73) Assignee: MAX CO., LTD., Tokyo (JP)

( * ) Notice: Subject to any disclaimer, the term of this patent is extended or adjusted under 35 U.S.C. 154(b) by 261 days.

(21) Appl. No.: 13/653,776

(22) Filed: Oct. 17, 2012

(65) Prior Publication Data

US 2013/0105188 A1 May 2, 2013

(30) Foreign Application Priority Data

Nov. 2, 2011 (JP) ..... 2011-241147
Nov. 24, 2011 (JP) ..... 2011-256019

(51) Int. Cl.
*B25F 5/00* (2006.01)
*B25B 21/02* (2006.01)

(52) U.S. Cl.
CPC ..... *B25B 21/02* (2013.01); *B25F 5/008* (2013.01)

(58) Field of Classification Search
CPC .... B25F 5/02; B25F 5/00; B25F 5/006; B25F 5/008; B25D 17/043; B25D 2250/371; B25D 17/04; B25D 2217/0061; G06K 7/10881; H01H 9/04
USPC ..... 173/170; 200/302.1, 302.2, 302.3
See application file for complete search history.

(56) References Cited

U.S. PATENT DOCUMENTS 2,468,469 A 4/1949 Smith
3,519,089 A * 7/1970 Schnettler ..... B23B 45/001 173/170
5,428,197 A * 6/1995 McCurry ..... B25F 5/00 200/302.1
5,598,082 A * 1/1997 Gilpin et al. ..... 200/293.1
7,705,497 B2 * 4/2010 Arich ..... B25D 16/00 173/117
8,089,019 B2 * 1/2012 Inagaki ..... H01H 9/063 200/522
8,496,074 B2 * 7/2013 Nishikimi ..... B25F 5/02 173/171
2003/0159843 A1 8/2003 Sakai et al.
2006/0048959 A1 3/2006 Sakai et al.
2006/0254666 A1 11/2006 Kusakari
2007/0221392 A1 * 9/2007 Britz ..... B25F 5/008 173/213
2007/0246237 A1 * 10/2007 Homsi ..... B25F 5/006 173/213
2009/0014194 A1 1/2009 Sakai et al.
2010/0163266 A1 * 7/2010 Matsunaga et al. ..... 173/217
2010/0253162 A1 * 10/2010 Sakamaki ..... B25D 16/00 310/50

(Continued)

FOREIGN PATENT DOCUMENTS

CN Y-2480110 3/2002
CN A-1439489 9/2003

(Continued)

*Primary Examiner* — Andrew M Tecco
*Assistant Examiner* — Chelsea Stinson
(74) *Attorney, Agent, or Firm* — Dinker Biddle & Reath LLP

(57) ABSTRACT

An electric tool (110) is provided with an output part (112) and a grip part (113). An elastic member (133) is provided between an outer wall surface (131*a*) of a trigger switch (130) and a housing inner wall surface (111*a*) of the grip part (113).

3 Claims, 10 Drawing Sheets

(56) References Cited

U.S. PATENT DOCUMENTS

| | | | | |
|---|---|---|---|---|
| 2010/0314147 | A1 | 12/2010 | Muller et al. | |
| 2011/0056813 | A1* | 3/2011 | Nishikimi | H01H 21/08 200/302.1 |
| 2011/0083868 | A1* | 4/2011 | Nishikimi | B25F 5/02 173/171 |

FOREIGN PATENT DOCUMENTS

| | | |
|---|---|---|
| CN | A-101767328 | 7/2010 |
| CN | A-102225543 | 10/2011 |
| DE | A1-10200805038 | 4/2010 |
| EP | A2-2214188 | 8/2010 |
| EP | A1-2293313 | 3/2011 |
| EP | A1-2311607 | 4/2011 |
| JP | UM-A-S53-141483 | 4/1977 |
| JP | UM-U-3009545 | 1/1995 |
| JP | A-H9-272072 | 10/1997 |
| JP | A-2004-122343 | 4/2004 |
| JP | A-2005-169532 | 6/2005 |
| JP | A-2006-315117 | 11/2006 |
| JP | A-2007-007821 | 1/2007 |
| JP | A-2007-283447 | 11/2007 |
| JP | A-2008-260103 | 10/2008 |
| JP | A-2009-21460 | 1/2009 |
| JP | A-2010-058156 | 3/2010 |
| JP | A-2010-120121 | 6/2010 |
| JP | A-2010-207992 | 9/2010 |
| JP | A-2010-214518 | 9/2010 |
| JP | A-2010-260152 | 11/2010 |
| JP | A-2011-83850 | 4/2011 |
| JP | 2011-142801 A | 7/2011 |
| JP | A-2011-183479 | 9/2011 |
| JP | A-2012-91309 | 5/2012 |
| TW | M335153 | 4/2009 |
| TW | I333013 | 11/2010 |

* cited by examiner

ELECTRIC TOOL

BACKGROUND OF THE INVENTION

Field of the Invention

The invention relates to an electric tool.

Related Art

An electric tool such as impact driver is provided with a cooling fan. The cooling fan generates cooling wind for cooling a motor and a control substrate. The external air is sucked from an intake hole formed at a housing and the motor and the control substrate are cooled by the air. Then, the air that has been used for the cooling is exhausted from an exhaust hole formed at the housing.

In an electric tool of Patent Document 1 (JP-A-2011-142801), since a cylindrical output part having a motor and a cooling fan arranged thereto communicates with a lower part of the housing, the air is sucked from a place other than the intake hole when the cooling fan is operated. For example, the air may be sucked from a gap between a trigger switch and the housing.

When the air is sucked from a place other than the intake hole, the cooling efficiency is lowered and dust is accumulated at the outside of a circulation route of the cooling wind.

According to the electric tool of Patent Document 1, the cooling fan and the motor control substrate are arranged on the same axis as the motor and the motor control substrate and the motor are cooled by the cooling wind that is generated by the cooling fan.

When the motor control substrate is arranged on the same axis as the motor, the motor control substrate can be efficiently cooled. However, the tool becomes larger in an axial direction of the motor, so that it is difficult to shorten an overall length of the tool.

SUMMARY OF THE INVENTION

Embodiments of the invention provide an electric tool capable of separating a circulation route of cooling wind in a housing.

Moreover, embodiments of the invention provide an electric tool capable of efficiently cooling a motor control substrate by cooling wind that is generated by a cooling fan and shortening an overall length of the tool.

DETAILED DESCRIPTION OF THE EMBODIMENTS

Hereinafter, exemplary embodiments of the invention will be described with reference to the accompanying drawings.

<First Exemplary Embodiment>

Figure 1:
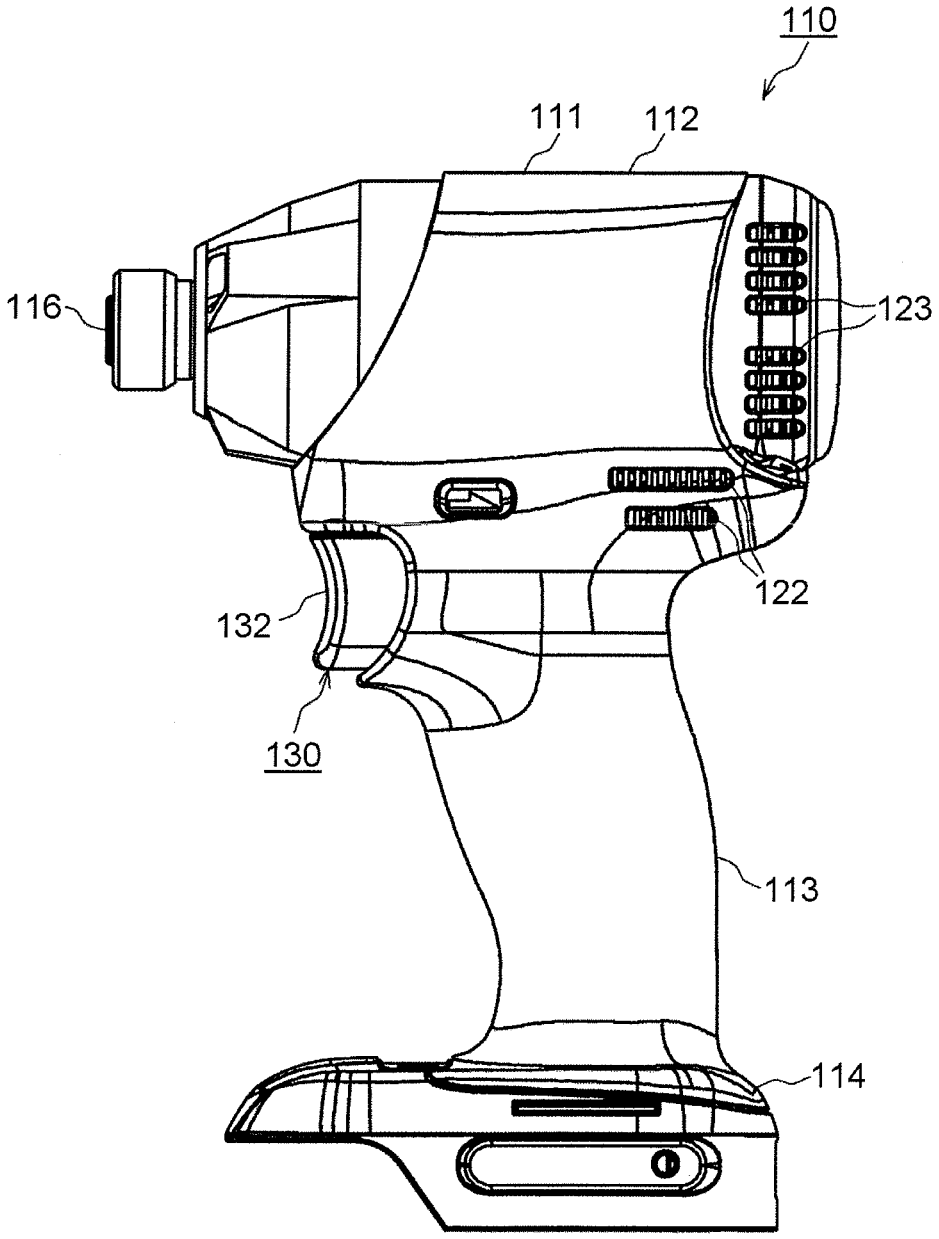
FIG. 1 is a side view of an electric tool according to a first exemplary embodiment.

An electric tool 110 of a first exemplary embodiment is an impact driver having a motor 115 mounted thereto and has a cylindrical output part 112, a grip part 113 provided below the output part 112 and extending in a direction substantially orthogonal to the output part 112 and a battery pack attachment part 114 provided at a lower part of the grip part 113, as shown in FIG. 1.

Figure 2:
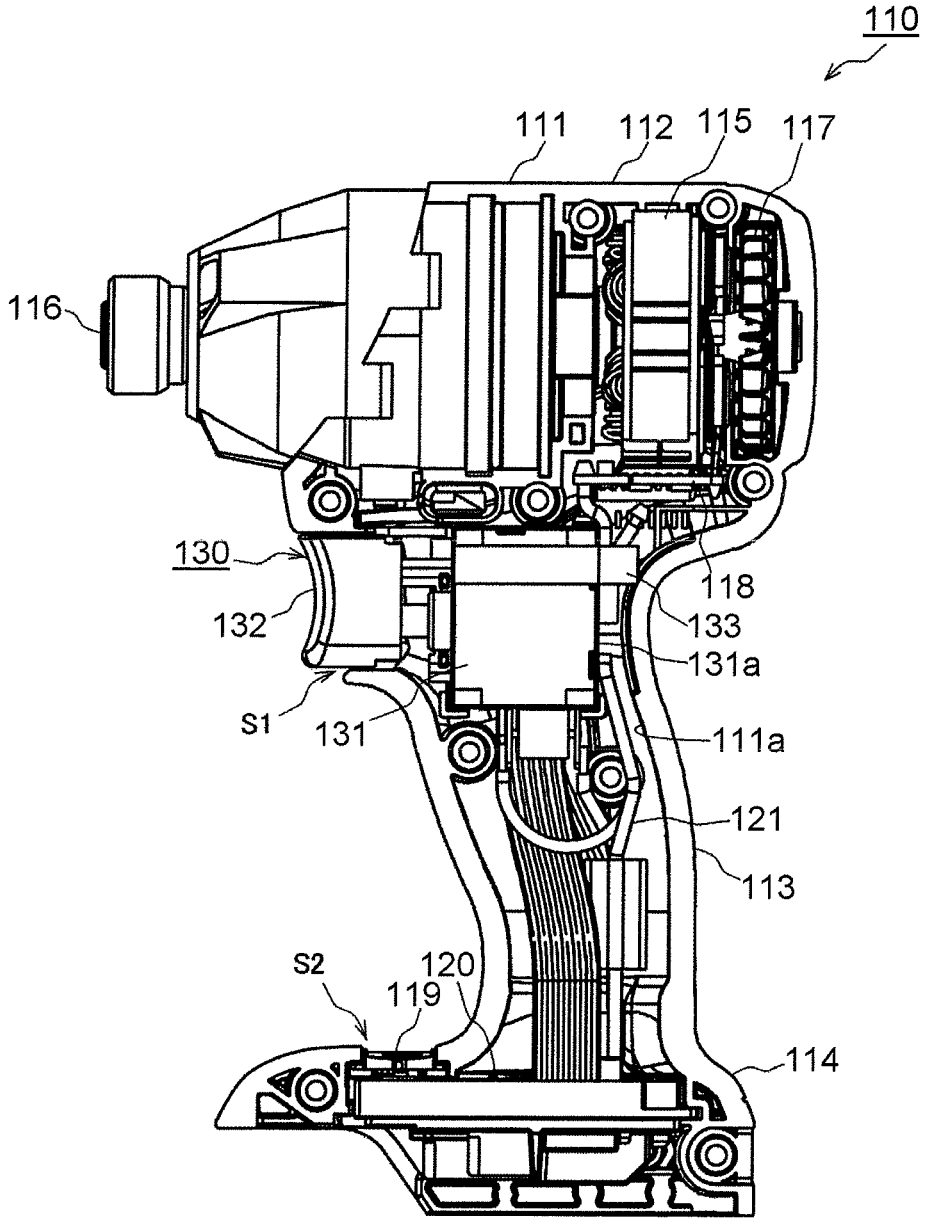
FIG. 2 is a side view showing an internal structure of the electric tool according to the first exemplary embodiment.

As shown in FIG. 2, the output part 112 has a motor 115 embedded therein, and a cooling fan 117, a spindle, a striking mechanism and an anvil are mounted in series therein on the same axis as a rotary shaft of the motor 115. A motor substrate 118 for controlling the motor 115 is arranged below the motor 115. The motor substrate 115 is connected to a trigger switch 130, an operation substrate 120 and a battery (which will be described later) through an electric wire 121 and the like.

A tip of the anvil is formed with an output shaft 116 to which a driver bit (tip tool) (not shown) can be mounted. When the motor 115 is rotated with the driver bit being mounted to the output shaft 116, the driver bit is rotated by a driving force of the motor 115, so that a screw engagement can be made.

The cooling fan 117 is arranged at the rearmost side of the output part 112 and is simultaneously rotated when the motor 115 rotates. Thereby, the external air is sucked from intake holes 122 (refer to FIG. 1) formed at a side of a housing 111 and the sucked air is exhausted to the outside from exhaust holes 123 (refer to FIG. 1) formed at the side of the housing 111.

The intake holes 122 are formed at a side of the motor substrate 118 and the exhaust holes 123 are formed at a side of the cooling fan 117. Thereby, the cooling wind sucked by the cooling fan 117 is exhausted from the adjacency of the motor substrate 118 to the outside via the inside of the motor 115, thereby efficiently cooling the motor substrate 118 and a coil of the motor 115.

The grip part 113 mounted below the output part 112 is a part for gripping the electric tool 110. As shown in FIG. 1, the trigger switch 130 is disposed at the front around a boundary line of the grip part 113 and the output part 112.

The trigger switch 130 is provided to operate the motor 115. As shown in FIG. 2, the trigger switch 130 has a box-shaped switch main body 131 that accommodates therein a contact point of a switch and a trigger part 132 that can be pressed to the switch main body 131. The trigger switch 130 is accommodated in the grip part 113. However, the trigger part 132 protrudes to the outside of the housing 111, so that the trigger switch can be operated. When the trigger part 132 is pulled, the motor 115 is rotated, so that the electric tool 110 starts to operate. The trigger part 132 is arranged at a position at which an index finger is placed when a user grips the grip part 113.

The battery pack attachment part 114 that is provided below the grip part 113 is a part for attaching and detaching a battery pack (not shown) to and from a lower surface thereof. An upper surface of the battery pack attachment part 114 is provided with an operation panel 119, as shown in FIG. 2. The operation panel 119 is provided with a mode setting button for changing a rotation mode, and the like.

The inside of the battery pack attachment part 114 positioned at a backside of the operation panel 119 is provided with an operation substrate 120 to which the respective buttons and lamps of the operation panel 119 are connected.

In the meantime, as shown in FIG. 2, there are a small gap S1 between the trigger switch 130 and the housing 111 and a small gap S2 between the operation panel 119 and the housing 111. The output part 112, the grip part 113 and the battery pack attachment part 114 communicate mutually in the housing 111. Thus, according to the conventional electric tool, when the cooling fan 117 is rotated, the air may be sucked from the gaps S1, S2. As a result, the cooling efficiency is lowered and dust is accumulated at the outside of a circulation route of the cooling wind.

In the first exemplary embodiment, in order to solve the above problem, a sponge seal 133 (sponge member) that is an example of an elastic member is provided between an outer wall surface 131*a* of the switch main body 131 and a housing inner wall surface 111*a* of the grip part 113. In the first exemplary embodiment, the semi-continuous and semi-independent foamed sponge seal 133 is used so as to secure both the waterproof and easy deformation properties.

Figure 3:
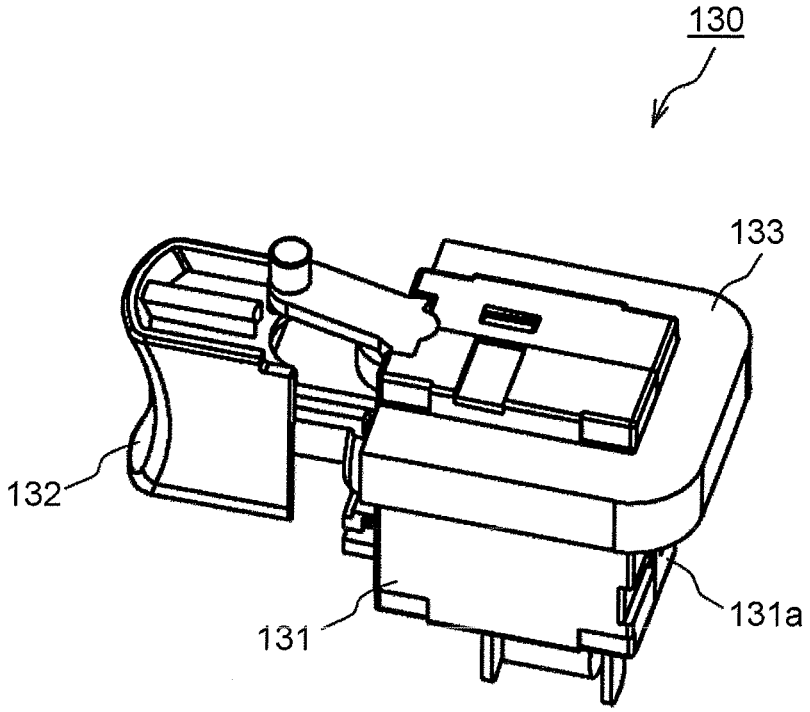
FIG. 3 is a perspective view of a trigger switch of the first exemplary embodiment.
Figure 4:
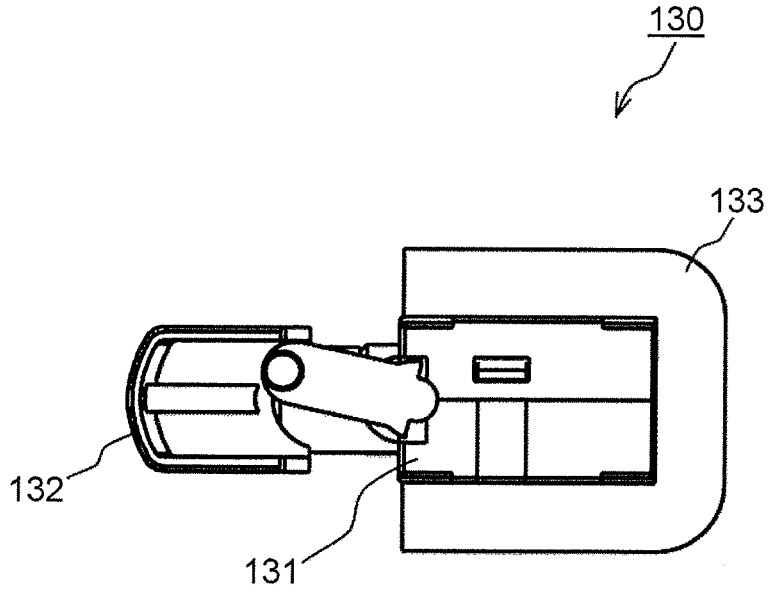
FIG. 4 is a plan view of the trigger switch of the first exemplary embodiment.

The sponge seal 133 has an adhesive part at a backside thereof. As shown in FIGS. 3 and 4, the sponge seal is adhesively fixed to an outer periphery of the switch main body 131 so that it can continuously wind the switch main body 131 from one side to the other side via a rear side without disconnection. Since the sponge seal 133 is adhered in advance, it is possible to isolate the circulation route of the cooling wind from the continuously wound sponge seal 133 simply by mounting the trigger switch 130 having the sponge seal 133 adhered thereto in the housing 111.

When the trigger switch 130 having the sponge seal 133 adhered thereto is mounted in the housing 111, the sponge seal 133 is deformed in correspondence to an internal shape of the housing 111, thereby plugging up the gap between the outer wall surface 131*a* of the switch main body 131 and the housing inner wall surface 111*a* of the grip part 113.

The sponge seal 133 fixes the electric wire 121 in the housing 111 to the switch main body 131. That is, the sponge seal 133 is wound with the electric wire 121 being closely contacted to the outer wall surface 131*a* of the trigger switch 130, so that the electric wire 121 is fixed to the switch main body 131 (the electric wire 121 is not shown in FIGS. 3 and 4 for convenience' sake), as shown in FIG. 2.

The electric wire 121 fixed with the sponge seal 133 includes an electric wire that connects the motor substrate 118 and the trigger switch 130, an electric wire that connects the motor substrate 118 and the operation substrate 120, an electric wire that connects the motor substrate 118 and a battery, and the like, for example.

The electric wire 121 in the housing 111 is fixed to the switch main body 131 by the sponge seal 133. Thus, it is possible to properly arrange the electric wire 121 by the sponge seal 133, thereby improving the assembling ability.

As described above, according to the first exemplary embodiment, since the elastic member 133 is provided between the outer wall surface 131*a* of the trigger switch 130 and the housing inner wall surface 111*a* of the grip part 113, a partition wall is formed in the housing 111 by the elastic member 133 between the output part 112 and the grip part 113. The partition wall is formed, so that when the cooling fan 117 of the output part 112-side is rotated, the air is not sucked from the grip part 113-side and is correctly sucked from the intake holes 122. Therefore, the problems that the cooling efficiency is lowered and that the dust is accumulated at the outside of a circulation route of the cooling wind are not caused.

Since the elastic member 133 serves as a cushion and the trigger switch 130 is thus protected against the shock, the durability of the trigger switch 130 can be improved.

In the first exemplary embodiment, the sponge seal 133 is adhered to the trigger switch 130. However, the sponge seal 133 may be adhered to the inner wall surface 111*a* of the housing 111 or the elastic member 133 may be inserted between the outer wall surface 131*a* of the trigger switch 130 and the housing inner wall surface 111*a* of the grip part 113.

In the first exemplary embodiment, the sponge member is used as the elastic member. However, the invention is not limited thereto. For example, a silicon rubber or gel-shaped filler may be also used as the elastic member.

According to the exemplary embodiments and modifications of the invention, the electric tool 110 may have the cylindrical output part 112, the grip part 113 provided below the output part 112 and extending in a direction intersecting with the output part 112, the motor 115 accommodated in the output part 112, the cooling fan 117 accommodated in the output part 112 and arranged on the same axis as the motor 115, the trigger switch 130 accommodated in the grip part 113 and operating the motor 115 and the elastic member 133 provided between the outer wall surface 131*a* of the trigger switch 130 and the housing inner wall surface 111*a* of the grip part 113.

According to the above structure, since the elastic member is provided between the outer wall surface of the trigger switch and the housing inner wall surface of the grip part, a partition wall is formed in the housing by the elastic member between the output part and the grip part. The partition wall is formed, so that when the cooling fan of the output part-side is rotated, the air is not sucked from the grip part-side and is correctly sucked from the intake holes. Therefore, the problems that the cooling efficiency is lowered and that the dust is accumulated at the outside of a circulation route of the cooling wind are not caused.

Since the elastic member serves as a cushion and the trigger switch is thus protected against the shock, the durability of the trigger switch can be improved.

In the above structure, the elastic member 133 may be a sponge member.

When the elastic member is a sponge member, it can be easily deformed. Hence, even when the internal shape of the housing is complicated, the elastic member is easily deformed to efficiently plug up the gap between the outer wall of the trigger switch and the housing inner wall of the grip part.

The sponge member 133 may be fixed to the outer periphery of the trigger switch 130.

When the sponge member is fixed to the outer periphery of the trigger switch, it is possible to isolate the circulation route of the cooling wind simply by attaching the trigger switch having the sponge member fixed thereto in the housing.

The electric wire 121 in the housing may be fixed to the trigger switch 130 by the sponge member 133.

When the electric wire in the housing is fixed to the switch main body by the sponge member, it is possible to properly arrange the electric wire by the sponge member, thereby improving the assembling ability.

<Second Exemplary Embodiment>

Figure 6:
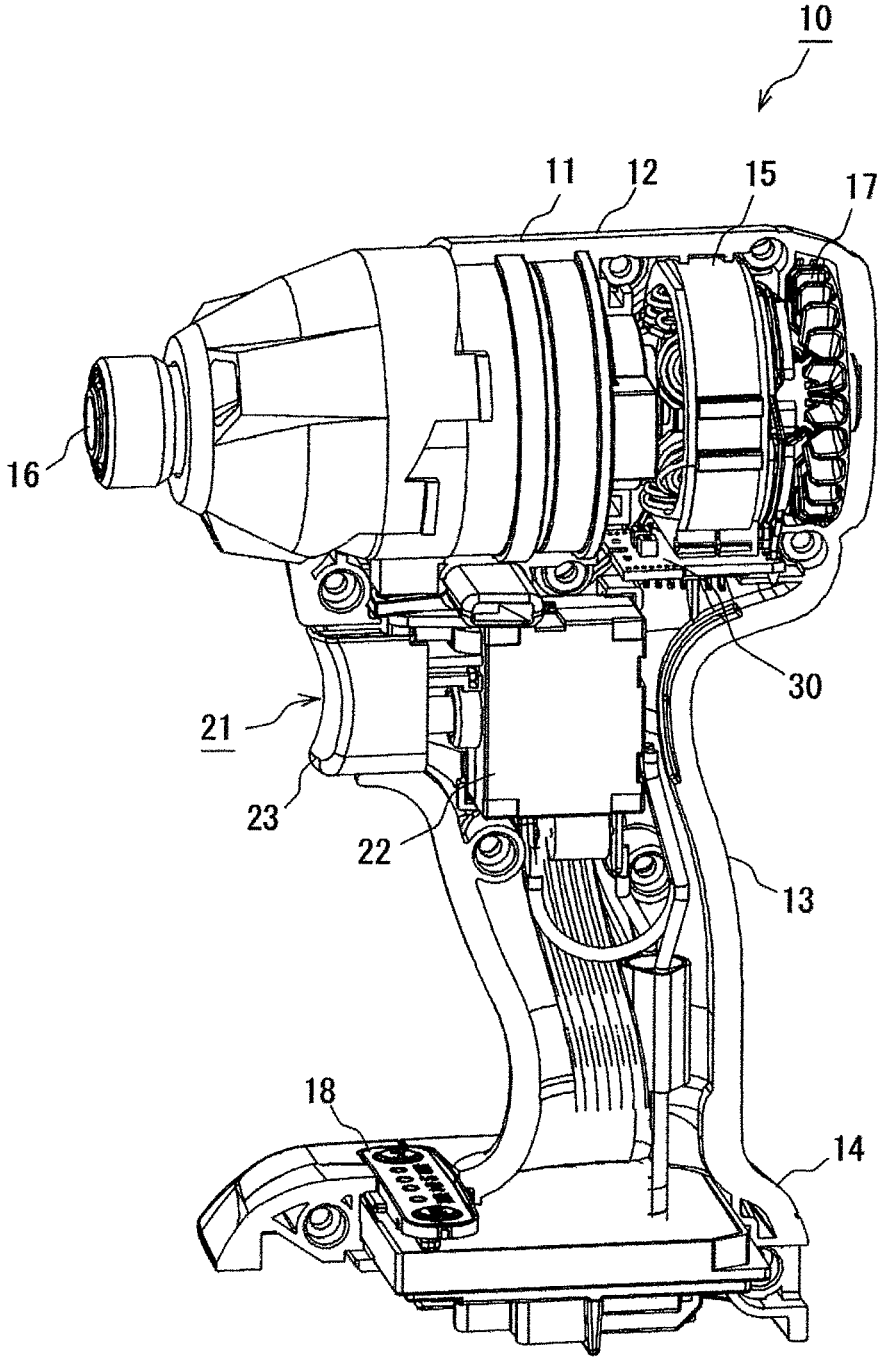
FIG. 6 shows an internal structure of the electric tool according to the second exemplary embodiment.

An electric tool 10 of a second exemplary embodiment is an impact driver having a motor 15 mounted thereto, and the motor 15 and the like are embedded in a housing 11, as shown in FIG. 6.

Figure 5:
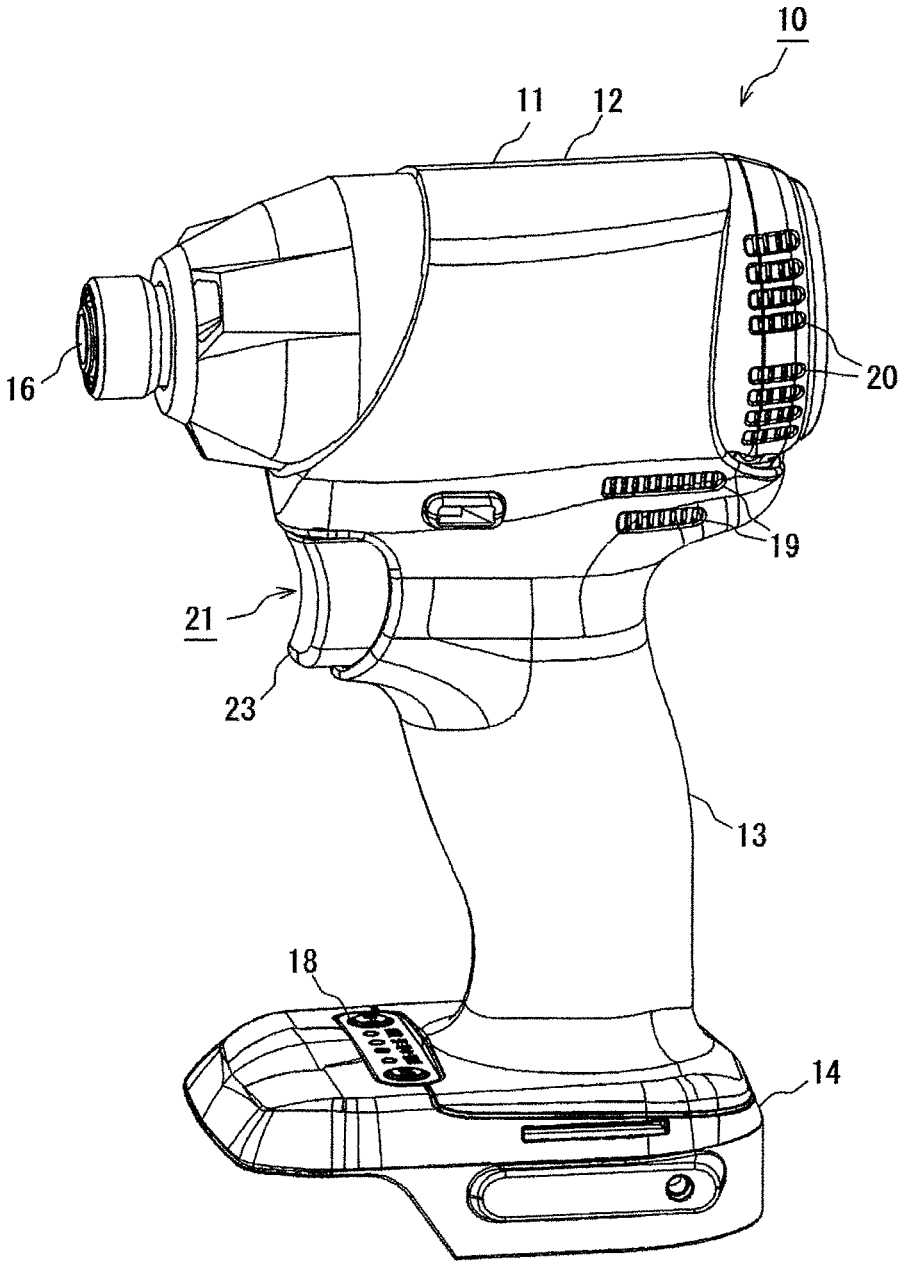
FIG. 5 shows an outward appearance of an electric tool according to a second exemplary embodiment.

As shown in FIG. 5, the housing 11 has a cylindrical output part 12, a grip part 13 provided below the output part 12 and extending in a direction substantially orthogonal to the output part 12 and a battery pack attachment part 14 provided at a lower part of the grip part 13.

As shown in FIG. 6, the output part 12 has the motor 15 embedded therein, and a cooling fan 17, a spindle, a striking mechanism and an anvil are mounted in series therein on the same axis as a rotary shaft of the motor 15. A motor control substrate 30 for controlling the motor 15 is arranged below the motor 15. Specifically, the motor control substrate 30 is arranged in a space between the motor 15 and a trigger switch 21 at a connection position of the output part 12 and the grip part 13 so that a surface of the motor control substrate is directed toward the motor 15. The motor control substrate 30 is connected to the trigger switch 21, an operation substrate and a battery (which will be described later) through an electric wire and the like.

A tip of the anvil is formed with an output shaft 16 to which a driver bit (tip tool) (not shown) can be mounted. When the motor 15 is rotated with the driver bit being mounted to the output shaft 16, the driver bit is rotated by a driving force of the motor 15, so that a screw engagement can be made.

The cooling fan 17 is arranged at the rearmost side of the output part 12 and is simultaneously rotated when the motor 15 rotates. Thereby, the external air is sucked from intake holes 19 (refer to FIG. 5) formed at a side of a housing 11 and the sucked air is exhausted to the outside from exhaust holes 20 (refer to FIG. 5) formed at the side of the housing 11.

The intake holes 19 are formed at a side of the motor control substrate 30 and the exhaust holes 20 are formed at a side of the cooling fan 17. Thereby, when the cooling fan 17 is operated, the cooling wind sucked from the intake holes 19 by the cooling fan 17 is exhausted from the adjacency of the motor control substrate 30 to the outside through the exhaust holes 20 via the inside of the motor 15, thereby efficiently cooling the motor control substrate 30 and a coil of the motor 15.

The grip part 13 mounted below the output part 12 is a part for gripping the electric tool 10. As shown in FIG. 5, the trigger switch 21 is disposed at the front around a boundary line of the grip part 13 and the output part 12.

The trigger switch 21 is provided to operate the motor 15. As shown in FIG. 6, the trigger switch 21 has a box-shaped switch main body 22 that accommodates therein a contact point of a switch and a trigger part 23 that can be pressed to the switch main body 22. The trigger switch 22 is accommodated in the grip part 13. However, the trigger part 23 protrudes to the outside of the housing 11, so that the trigger switch can be operated. When the trigger part 23 is pulled, the motor 15 is rotated, so that the electric tool 10 starts to operate. The trigger part 23 is arranged at a position at which an index finger is placed when a user grips the grip part 13.

The battery pack attachment part 14 that is provided below the grip part 13 is a part for attaching and detaching a battery pack (not shown) to and from a lower surface thereof. An upper surface of the battery pack attachment part 14 is provided with an operation panel 18, as shown in FIG. 5. The operation panel 18 is provided with a mode setting button for changing a rotation mode, and the like.

The inside of the battery pack attachment part 14 positioned at a backside of the operation panel 18 is provided with an operation substrate to which the respective buttons and lamps of the operation panel 18 are connected.

The motor 15 is a three-phase alternating current brushless motor and is driven as switching devices 31 to 36 such as FETs become on and off. The switching devices 31 to 36 are mounted on the motor control substrate 30.

Figure 8:
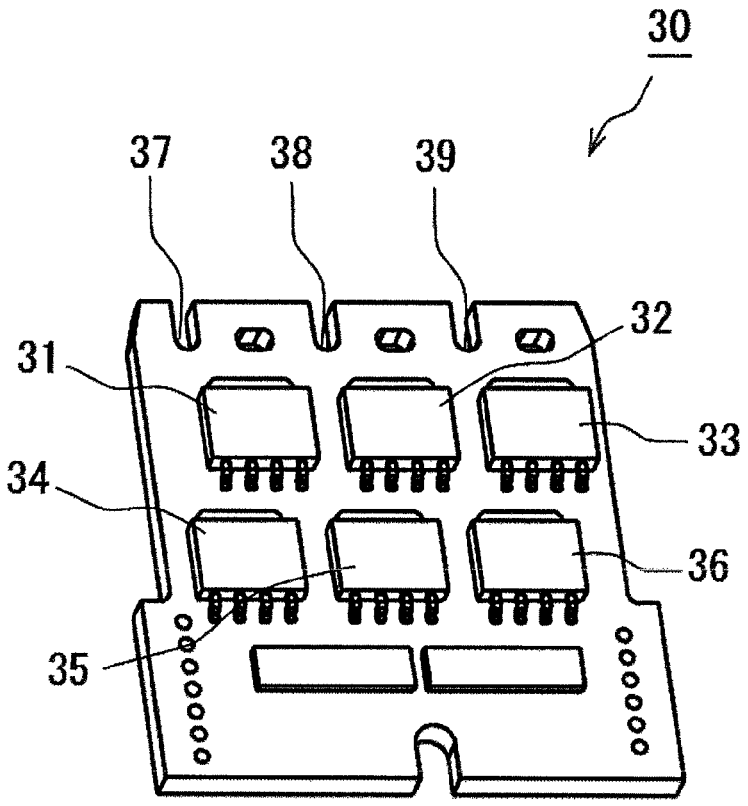
FIG. 8 shows an outward appearance of the motor control substrate according to the second exemplary embodiment.

As shown in FIG. 8, the motor control substrate 30 is a rectangular thin plate and the six switching devices 31 to 36 are mounted on a surface of the motor control substrate so as to switch respective activations of U, V and W phases of the motor 15.

Figure 7:
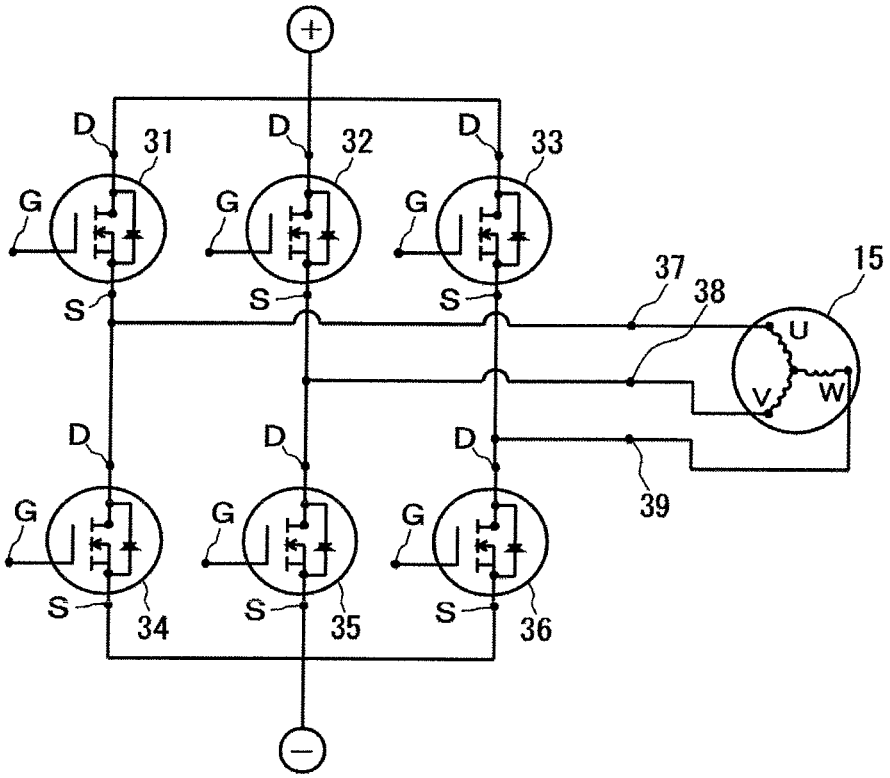
FIG. 7 is a schematic view of a motor control substrate according to the second exemplary embodiment.

The three switching devices 31 to 33 are configured so that drains D are connected to a positive electrode of the battery and sources S are connected to drains D of the other three switching devices 34 to 36 (refer to FIG. 7). Specifically, the source S of the switching device 31 is connected to the drain D of the switching device 34, the source S of the switching device 32 is connected to the drain D of the switching device 35 and the source S of the switching device 33 is connected to the drain D of the switching device 36. The sources S of the switching devices 34 to 36 are connected to a negative electrode of the battery.

The respective gates G of the six switching devices 31 to 36 are connected to a control signal output circuit (not shown) mounted on the motor control substrate 30, so that the activations are controlled.

The motor control substrate 30 has three motor connection terminals 37 to 39 of a motor connection terminal 37 that is connected to a U-phase coil of the motor 15, a motor connection terminal 38 that is connected to a V-phase coil of the motor 15 and a motor connection terminal 39 that is connected to a W-phase coil of the motor 15.

A connection point of the switching device 31 and the switching device 34 is connected to the motor connection terminal 37. Thereby, the switching device 31, the switching device 34 and the motor connection terminal 37 are allotted to the U-phase.

A connection point of the switching device 32 and the switching device 35 is connected to the motor connection terminal 38. Thereby, the switching device 32, the switching device 35 and the motor connection terminal 38 are allotted to the V-phase.

A connection point of the switching device 33 and the switching device 36 is connected to the motor connection terminal 39. Thereby, the switching device 33, the switching device 36 and the motor connection terminal 39 are allotted to the W-phase.

In the second exemplary embodiment, the switching devices 31 to 36 and motor connection terminals 37 to 39 allotted to the respective phases are intensively arranged for the respective phases, so that a distance of a conduction path on the substrate is shortened and a surface area of the motor control substrate 30 is reduced.

The switching devices and motor connection terminals may be intensively arranged for the respective phases, as follows.

That is, regarding a positional relation of the motor connection terminal 37 and three switching devices 31 to 33 connected to the positive electrode, which are allotted to any phase (for example, U-phase), the switching device 31 allotted to the phase (U-phase) has only to be arranged at a closer position to the motor connection terminal 37 than the other switching devices 32, 33.

Likewise, regarding a positional relation of the motor connection terminal 37 and three switching devices 34 to 36 connected to the negative electrode, which are allotted to any phase (for example, U-phase), the switching device 34 of the phase (U-phase) has only to be arranged at a closer position to the motor connection terminal 37 than the other switching devices 35, 36.

Specifically, as shown in FIG. 8, one side edge of the rectangular motor control substrate 30 is formed with the three motor connection terminals 37 to 39, the two switching devices 31, 34 allotted to the U-phase are arranged so that they continue to the motor connection terminal 37 allotted to the U-phase, the two switching devices 32, 35 allotted to the V-phase are arranged so that they continue to the motor connection terminal 38 allotted to the V-phase and the two switching devices 33, 36 allotted to the W-phase are arranged so that they continue to the motor connection terminal 39 allotted to the W-phase. At this time, the two switching devices of one set allotted to each of the U, V and W-phases are arranged at different heights, so that a conduction path pattern connecting the switching devices is configured by the shortest distance.

Figure 9:
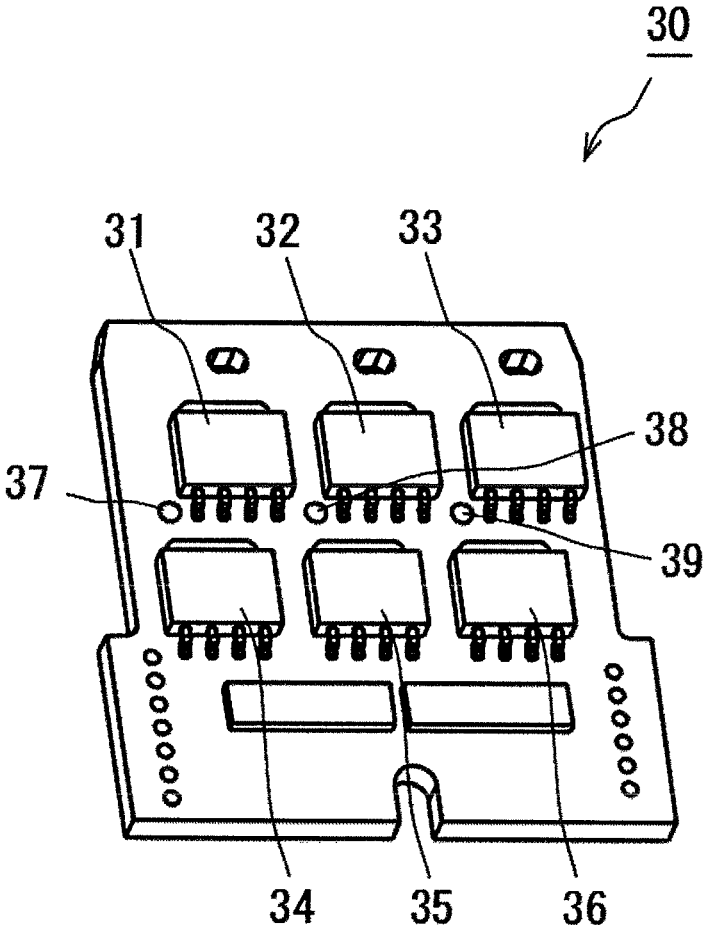
FIG. 9 shows an outward appearance of a motor control substrate according to a first modification of the second exemplary embodiment.
Figure 10:
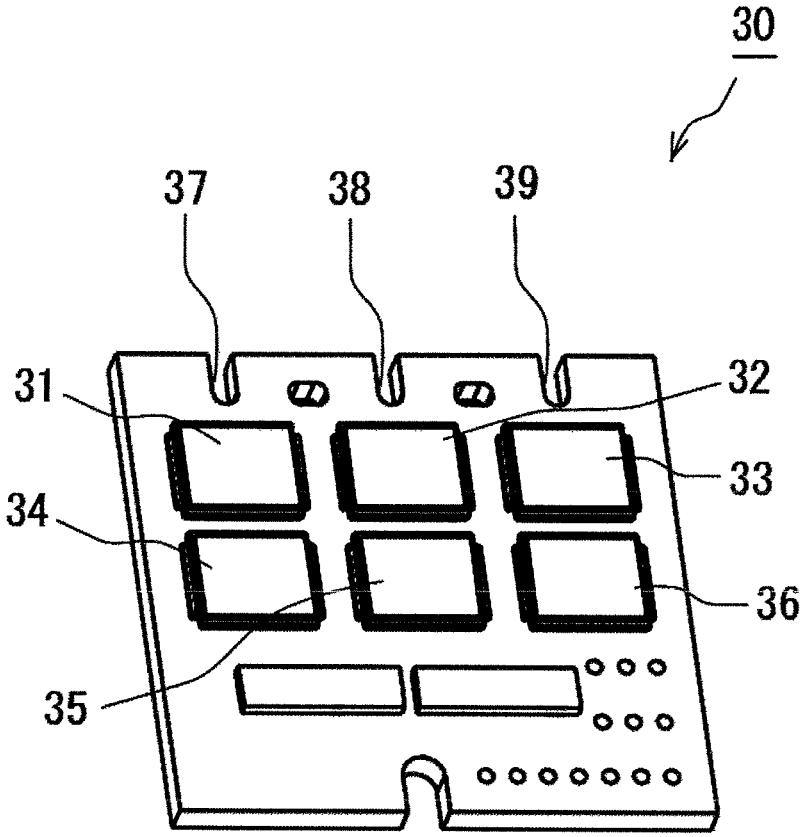
FIG. 10 shows an outward appearance of a motor control substrate according to a second modification of the second exemplary embodiment.
Figure 11:
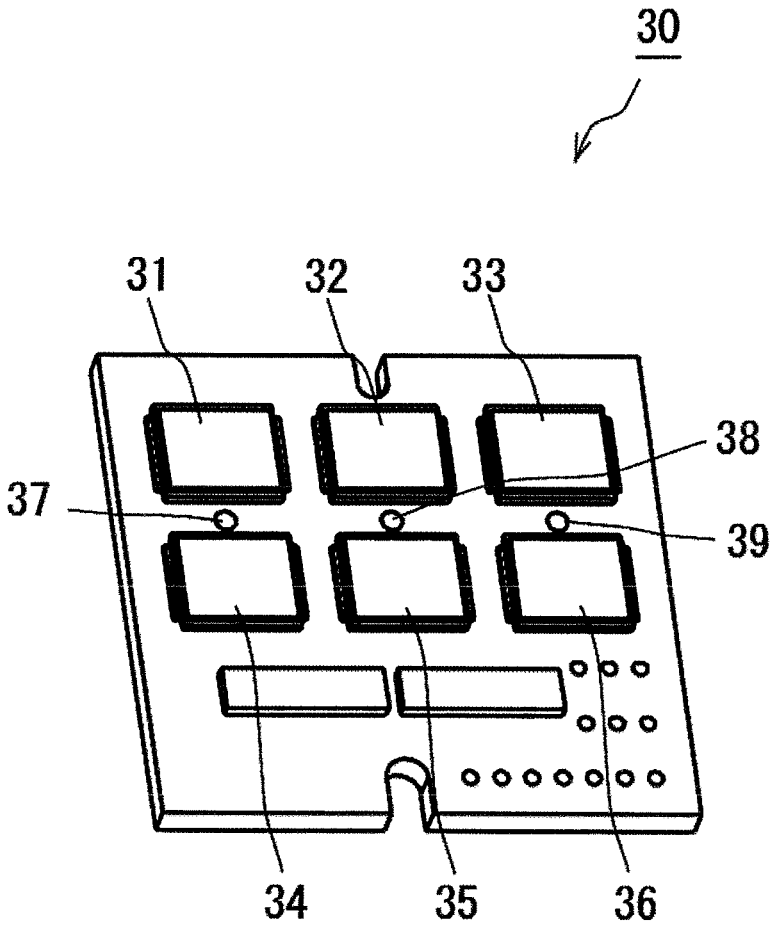
FIG. 11 shows an outward appearance of a motor control substrate according to a third modification of the second exemplary embodiment.

Arrangements as shown in FIGS. 9 to 11 may be adopted without being limited to the arrangement shown in FIG. 8.

That is, as shown in FIG. 9, the motor connection terminals 37 to 39 may be formed on a surface of the motor control substrate 30, instead of the configuration in which the motor connection terminals are formed at one side. Specifically, the motor connection terminal 37 allotted to the U-phase is arranged between the two switching devices 31, 34 allotted to the U-phase, the motor connection terminal 38 allotted to the V-phase is arranged between the two switching devices 32, 35 allotted to the V-phase and the motor connection terminal 39 allotted to the W-phase is arranged between the two switching devices 33, 36 allotted to the W-phase. At this time, the two switching devices of one set allotted to each of the U, V and W-phases are arranged at different heights, so that a conduction path pattern connecting the switching devices is configured by the shortest distance.

As shown in FIG. 10, one side edge of the rectangular motor control substrate 30 is formed with the three motor connection terminals 37 to 39, the two switching devices 31, 34 allotted to the U-phase are arranged so that they continue to the motor connection terminal 37 allotted to the U-phase, the two switching devices 32, 35 allotted to the V-phase are arranged so that they continue to the motor connection terminal 38 allotted to the V-phase and the two switching devices 33, 36 allotted to the W-phase are arranged so that they continue to the motor connection terminal 39 allotted to the W-phase. At this time, the two switching devices of one set allotted to each of the U, V and W-phases are arranged in parallel, instead of being arranged at different heights.

As shown in FIG. 11, the motor connection terminal 37 allotted to the U-phase is arranged between the two switching devices 31, 34 allotted to the U-phase, the motor connection terminal 38 allotted to the V-phase is arranged between the two switching devices 32, 35 allotted to the V-phase and the motor connection terminal 39 allotted to the W-phase is arranged between the two switching devices 33, 36 allotted to the W-phase. At this time, the two switching devices of one set allotted to each of the U, V and W-phases are arranged in parallel, instead of being arranged at different heights.

In the second exemplary embodiment as described above, the motor control substrate 30 is arranged only in the space between the motor 15 and the trigger switch 21 at the connection position of the output part 12 and the grip part 13 so that the surface of the motor control substrate is directed toward the motor 15. Thus, the motor 15 and the motor control substrate 30 can be efficiently cooled by the cooling wind generated by the cooling fan 17. Therefore, even when heat generation is increased as the motor control substrate 30 performs the precise rotation control, it is possible to cope with the corresponding situation. Hence, it is possible to cope with a fine using operation of a user.

Since the motor control substrate 30 is not arranged on the same axis as the motor 15 (since the motor control substrate 30 is arranged only in the space between the motor 15 and the trigger switch 21 and is arranged so that the motor control substrate 30 and the motor 15 do not overlap with each other when projected in the axial direction of the motor 15), it is possible to shorten the overall length of the tool, thereby making the electric tool 10 smaller.

Since the switching devices 31 to 36 and the motor connection terminals 37 to 39 are intensively arranged for the respective phases, it is possible to minimize the area of the motor control substrate 30. Thereby, even when a space for arranging the motor control substrate 30 is small, it is possible to miniaturize and accommodate the motor control substrate 30.

The housing 11 is formed with the intake holes 19 that are opened at the side of the motor control substrate 30. Thus, when the cooling fan 17 is operated, the air is sucked from the intake holes 19. Accordingly, since the cooling wind circulates while securely contacting the switching devices 31 to 36 mounted on the motor control substrate 30, the motor control substrate 30 can be efficiently cooled.

According to the exemplary embodiments and modifications of the invention, the electric tool 10 may have the housing 11, the motor 15 accommodated in the housing 11, the cooling fan 17 arranged on the same axis as the motor 15, the trigger switch 21 for operating the motor 15 and the thin plate-shaped motor control substrate 30 having the switching devices 31 to 36 for driving the motor 15 mounted thereon, the housing 11 may have the output part 12 accommodating the motor 15 and the cooling fan 17 and the grip part 13 connected to and intersecting with the output part 15 and accommodating the trigger switch 21, and the motor control substrate 30 may be arranged in the space between the motor 15 and the trigger switch 21 at the connection position of the output part 12 and the grip part 15 so that the surface of the motor control substrate is directed toward the motor 15.

According to the above structure, since the motor control substrate is arranged in the space between the motor and the trigger switch at the connection position of the output part and the grip part so that the surface of the motor control substrate is directed toward the motor, it is possible to efficiently cool the motor and the motor control substrate by the cooling wind generated by the cooling fan. Therefore, even when the heat generation is increased as the motor control substrate performs the precise rotation control, it is possible to cope with the corresponding situation. Hence, it is possible to cope with the fine using operation of a user.

Since the motor control substrate is not arranged on the same axis as the motor, it is possible to shorten the overall length of the tool, thereby making the electric tool smaller.

The motor 15 may be the three-phase alternating current motor, the motor control substrate 30 may be mounted with the two switching devices 31 to 36 and motor connection terminals 37 to 39 for each of the U, V and W phases and the switching devices 31 to 36 and motor connection terminals 37 to 39 may be intensively arranged for the respective phases.

According to the above structure, since the switching devices and motor connection terminals are intensively arranged for the respective phases, it is possible to minimize the area of the motor control substrate. Thereby, even when a space for arranging the motor control substrate is small, it is possible to miniaturize and accommodate the motor control substrate.

The housing 11 is formed with the intake holes 19 that are opened at the side of the motor control substrate 30. Thus, the air is sucked from the intake holes 19 when operating the cooling fan 17.

The housing is formed with the intake holes that are opened at the side of the motor control substrate. Thus, the air can be sucked from the intake holes when operating the cooling fan. Thereby, since the cooling wind securely contacts the motor control substrate, it is possible to efficiently cool the motor control substrate.

What is claimed is:

1. An electric tool having a housing comprising:

a cylindrical output part;

a grip part provided below the output part and extending in a direction intersecting with the output part;

a motor accommodated in the output part;

a cooling fan accommodated in the output part and coaxially-arranged with the motor;

a trigger switch accommodated in the grip part and provided to operate the motor, the trigger switch including a box shaped switch main body and a trigger part; and an elastic member provided to fit a gap between an outer wall surface of the box shaped switch main body and a housing inner wall surface of the grip part by changing a shape of the elastic member according to a shape of the housing inner wall surface so as to form a partition wall in the housing between the output part and the grip part, the elastic member forming a circulation route of the cooling fan in the output part so as to isolate the circulation route from the grip part, wherein the elastic member is adhesively fixed to an outer periphery of the box shaped switch main body such that the elastic member continuously winds the outer periphery of the box shaped switch main body from a first side to a second side via a rear side, and wherein the elastic member is wound with an electric wire being closely contacted to the rear side of the outer periphery of the box-shaped switch main body, so that the electric wire is bed to the box-shaped switch main body.

2. The electric tool according to claim 1, wherein the elastic member comprises a sponge member.

3. The electric tool according to claim 2, wherein an electric wire in the housing is fixed to the trigger switch by the sponge member.

* * * * *